US006095831A

United States Patent [19]

Muramatsu et al.

[11] Patent Number: 6,095,831

[45] Date of Patent: Aug. 1, 2000

[54] ELECTRICAL CONNECTOR MATING STRUCTURE

[75] Inventors: Kenji Muramatsu; Shigemitsu Inaba, both of Shizuoka, Japan

[73] Assignee: Yazaki Corporation, Tokyo, Japan

[21] Appl. No.: 09/261,743

[22] Filed: Mar. 3, 1999

[30] Foreign Application Priority Data

May 3, 1998 [JP] Japan ..... 10-053539

[51] Int. Cl.[7] ..... H01R 13/60

[52] U.S. Cl. ..... 439/131; 439/157; 439/372; 439/571

[58] Field of Search ..... 439/131, 571, 439/572, 157, 372, 357, 310, 160

[56] References Cited

U.S. PATENT DOCUMENTS

| | | | |
|---|---|---|---|
| 4,714,433 | 12/1987 | Rider, Jr. | 439/372 |
| 5,924,880 | 7/1999 | Watanabe et al. | 439/157 |
| 5,954,528 | 9/1999 | Ono et al. | 439/157 |

*Primary Examiner*—Gary F. Paumen
*Assistant Examiner*—Tho D. Ta
*Attorney, Agent, or Firm*—Armstrong, Westerman, Hattori, McLeland & Naughton

[57] ABSTRACT

The mating structure includes a bracket defined to be fitted to a base body. The bracket has a guide portion consisting of an inclined portion and a lock opening turned from the inclined portion. The structure further has a first connector pivotably attached to the bracket and a second connector provided on a fitting panel constructed to be attached to the base body. The second connector has an engagement piece associated with the guide portion of the bracket. The fitting panel is pivotable toward the base body side when the first and second connectors have mated completely. The first and second connectors are completely mated with each other when the engagement piece has reached the lock opening. The lock opening is directed perpendicularly to the disengagement direction of the first and second connectors when the fitting panel has completely pivoted toward the base body. The structure may include a third connector mounted on the base body and a fourth connector that is provisionally held by a resilient holding arm formed on the fitting panel. The attachment completion of the fitting panel also allows the complete mating of the third and fourth connectors.

6 Claims, 7 Drawing Sheets

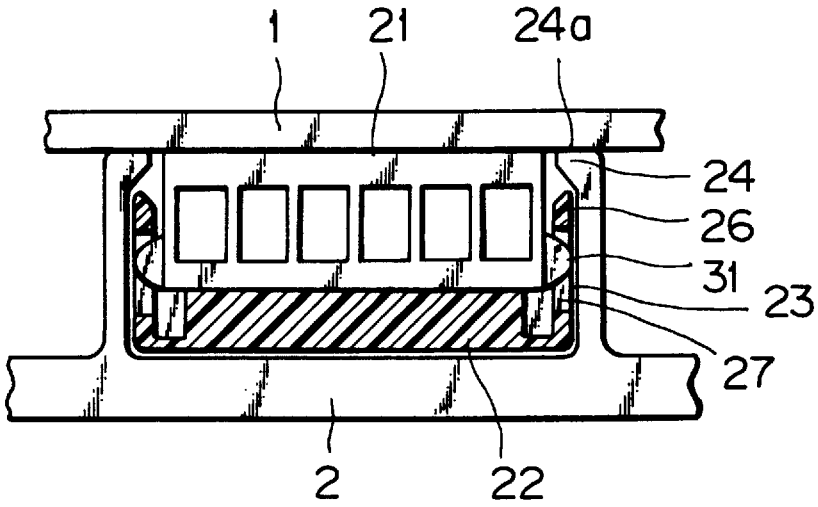
F I G. 7
F I G. 8
PRIOR ART
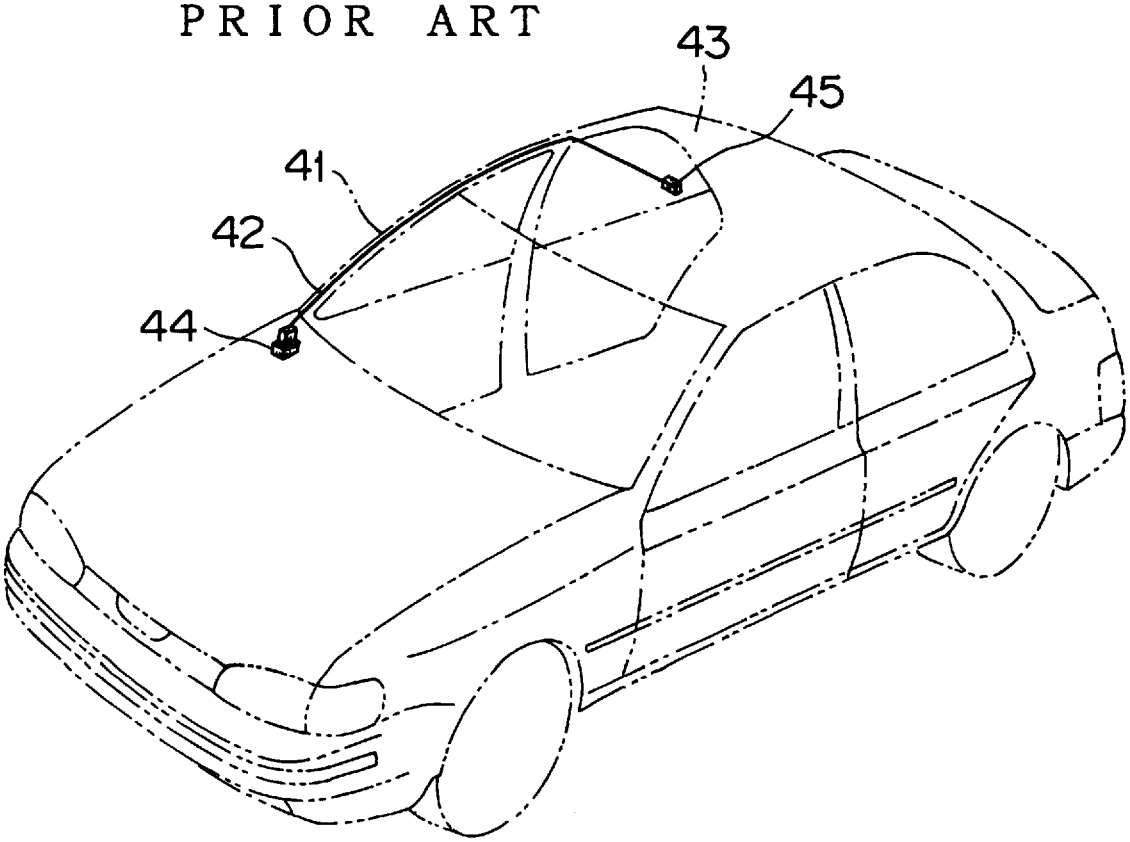

ELECTRICAL CONNECTOR MATING STRUCTURE

BACKGROUND OF THE INVENTION

1. Field of the Invention

The present invention relates to an electrical connector mating structure, particularly to a mating structure for connecting a connector that is mounted on a pillar trim for an electrical circuit provided in a car pillar portion to another connector provided in a car body side. The connector mating can be completed simultaneously with securing the pillar trim to the car body.

2. Prior Art

FIG. 8 shows a conventional connector mating structure used in a wiring harness located around a car pillar.

In relation to the structure, on a front pillar 41 of the car is disposed a wiring harness 42. The wiring harness 42 extends to the middle of the car roof 43 at the upper side end thereof. Each end of the wiring harness 42 has a connector 44 or 45 that will mate with an associated opposing connector (not shown). After the mating of the connectors, a pillar trim or furnishing (not shown) made of a synthetic resin will be fitted to the pillar 41 to cover the wiring harness 42.

However, the conventional structure requires to mount the wiring harness 42 before attachment of the pillar trim, in which a more efficient mounting step thereof would be expected. Furthermore, since the mating work of the connectors 44, 45 is done in a narrow space of the car cabin, there is a possibility of incomplete mating of the connectors 44, 45.

To eliminate the disadvantage, the applicant of the present invention proposed previously another connector mating structure for a wiring harness disposed around a car pillar, which is illustrated in FIGS. 9 and 10.

In this structure, as shown in FIG. 9, a pillar trim 46 made of a synthetic resin is fitted with a wiring harness 47. Each end of the wiring harness 47 has a connector 48 or 49 extending respectively from one of upper and lower ends of the pillar trim 46. At the same time, another roof trim 51 is fitted with a roof side wiring harness 52. One end of the wiring harness 52 has a connector 53 extending from a periphery of the roof trim 51. When the pillar trim 46 is attached to a car front pillar 50, the roof trim 51 is also fitted to the car roof, in which the connectors 48, 53 of the wiring harnesses 47, 52 are manually coupled to each other. Denoted 54 in FIG. 9 is a soft sticky tape for securing the wiring harnesses, and denoted 55 is an opening for mounting an auxiliary instrument.

As shown in FIG. 10, the pillar side wiring harness 47 connects with wiring harnesses 56 to 58 arranged in a roof side instrument panel or in a door through the connector 48 or 49. In the roof, there are mounted a room lamp unit and a roof window actuating unit. In the instrument panel, there are arranged a meter unit, and in the door, there are assembled such auxiliary units as a power window motor, a door mirror actuating motor, and a switch unit. A wiring harness 57 arranged in the instrument panel leads to a battery. Thereby, the pillar side wiring harness 47 supplies electric energy to the roof side auxiliary units, and the switch unit disposed in the door side can operate to open and dose the roof window.

SUMMARY OF THE INVENTION

However, in the above-mentioned structure, the connectors 48, 49 of the pillar side wiring harness 47 each must be mated with an associated connector still by hand work in a narrow working space, there has been also the possibility of incomplete mating of the connectors 48 or 49. In addition, since the wiring harness 47 is secured to the pillar trim 46, the connectors 48, 49 vibrate together with the pillar trim 46. Meanwhile, the connectors 48, 49 each have been desired to keep a secure locking state after mating with an associated connector so that the connectors 48, 49 each may not disengage or may not make an insufficient electrical connection due to vibration from the car body during operation of the car.

In view of the above-mentioned disadvantage, an object of the present invention is to provide an electrical connector mating structure that eliminates incomplete engagement of connectors for wiring harnesses. Furthermore, the connector mating structure enables a secure locking state after mating of the connectors to keep a sufficient electrical connection thereof as well as improvement in the fitting work of a wiring harness and a pillar trim around a car pillar.

For achieving the object, an electrical connector mating structure of a first configuration of the present invention, includes:

a bracket defined to be fitted to a base body, the bracket having a guide portion that includes an inclined portion and a lock opening turned from the inclined portion, a first connector pivotably attached to the bracket, and a second connector provided on a fitting panel constructed to be attached to the base body, the second connector having an engagement piece associated with the guide portion of the bracket, wherein the fitting panel is pivotable toward the base body when the first and second connectors have mated completely.

In a second configuration of the present invention depended on the first configuration, the first connector can be preliminarily supported by the bracket with the first connector being inclined to the base body, and the inclined portion is extending in a direction so that the first and second connectors can mate with each other. The first and second connectors completely mate with each other when the engagement piece has reached the lock opening. The lock opening is directed perpendicularly to the disengagement direction of the first and second connectors when the fitting panel has completely pivoted toward the base body.

An electrical connector mating structure of a third configuration of the present invention, includes:

a third connector mounted on a base body, the third connector having a connecting protrusion, a resilient holding arm mounted on a fitting panel constructed to be attached to the base body, the resilient holding arm having an engagement projection, a fourth connector provisionally held by the resilient holding arm, the fourth connector having a resilient connection arm with a connection hole, the connection hole provisionally engaging with the connecting protrusion, wherein the connecting protrusion can deflect the resilient connection arm during mating of the third and fourth connectors so that the resilient connection arm pushes the resilient holding arm to disengage it from the connection hole, and the connecting protrusion can engage with the connection hole when the third and fourth connect mate with each other completely.

In a forth configuration of the present invention depended on the third configuration, a receiving space for accommodating the mated third and fourth connectors is provided inside a pair of the holding arms each positioned each side of the fourth connector, and the fourth connector is protruding from the holding arm in the engagement direction of the fourth connector when the engagement projection has engaged with the connection hole.

In a fifth configuration of the present invention depended on the first configuration, the third and fourth connectors as described in the third configuration are arranged respectively to the base body or the fitting panel.

Operation of the aforementioned configurations will be discussed hereinafter.

Referring to the first and second configurations, the fitting panel is initially positioned to keep an inclined state toward the base body, while the connectors begin to mate with each other and simultaneously the engagement piece moves along the inclined portion of the guide portion. In a state of incomplete mating of the connectors where the engagement piece is abutting against the inclined portion, the fitting panel can not pivot. However, after complete mating of the connectors, the fitting panel is pivoted together with the connectors to fit itself to the base body. The pivoting operation advances the engagement piece into the lock opening so that the connectors are locked to each other.

Referring to the third and fourth configurations, the fitting panel is attached to the base body, while the connectors mate with each other. During the mating, the connecting protrusion deflects the connection arm outwardly and the connecting protrusion advances into the connection hole. At the same time, the connecting protrusion pushes the resilient holding arm outwardly to disengage the engagement projection from the connection hole. Thus, the fourth connector is released from the holding arm of the fitting panel so as to mate with the third connector. In incomplete mating of the connectors, the pair of connectors have been advanced insufficiently in the receiving space and the fitting panel has not been finally located in a position opposed to the base body.

Referring to the fifth configuration, pivoting the fitting panel can mate the third connector with the fourth connector.

Advantageous effects of the Invention will be discussed hereinafter.

As describe above, according to the first or second configurations of the invention, where the connectors have mated incompletely with each other, the engagement piece abuts against the inclined portion, preventing the pivoting movement of the fitting panel. Thereby, the incomplete mating of the connectors is surely easily recognized to correct it. Furthermore, simultaneously with the complete mating of the connectors, the engagement piece of the second connector is surely locked to the lock opening of the bracket. This keeps the complete mating state of the connectors, improving the connectors in electrical connection thereof. In addition, after the mating of the connectors, a simple pivoting operation of the fitting panel causes the fitting panel to be fitted to the base body, allowing a more easy fitting work thereof.

According to the third or fourth configurations of the invention, where the connectors have mated incompletely with each other, the fitting panel has been incompletely fitted to the base body, so that the incomplete mating of the connectors is easily recognized. Pushing the fitting panel toward the base body allows the complete mating of the connectors. In addition, simultaneously with the complete mating of the connectors, the fourth connector is released from the holding arm to be free from the fitting panel, and the third and fourth connectors mate completely. This prevents the connectors (in particular, the terminals therein) from receiving undesirable vibrations from the fitting panel, improving the electrical connection thereof in reliability.

According to the fifth configuration of the invention, pivoting the fitting panel allows a sure mating of the third and fourth connectors, and the fitting completion of the fitting panel assures the complete mating all of the first to fourth connectors.

BRIEF DESCRIPTION OF THE DRAWINGS

FIG. 7 is a cross-sectional view showing a state that a fitting panel has been fitted to a base body;

FIG. 8 is a perspective view showing a conventional electrical connector mating structure;

DETAILED DESCRIPTION OF PREFERRED EMBODIMENTS

Referring to the accompanied drawings, embodiments of the present invention will be discussed in detail hereinafter.

Figure 1:
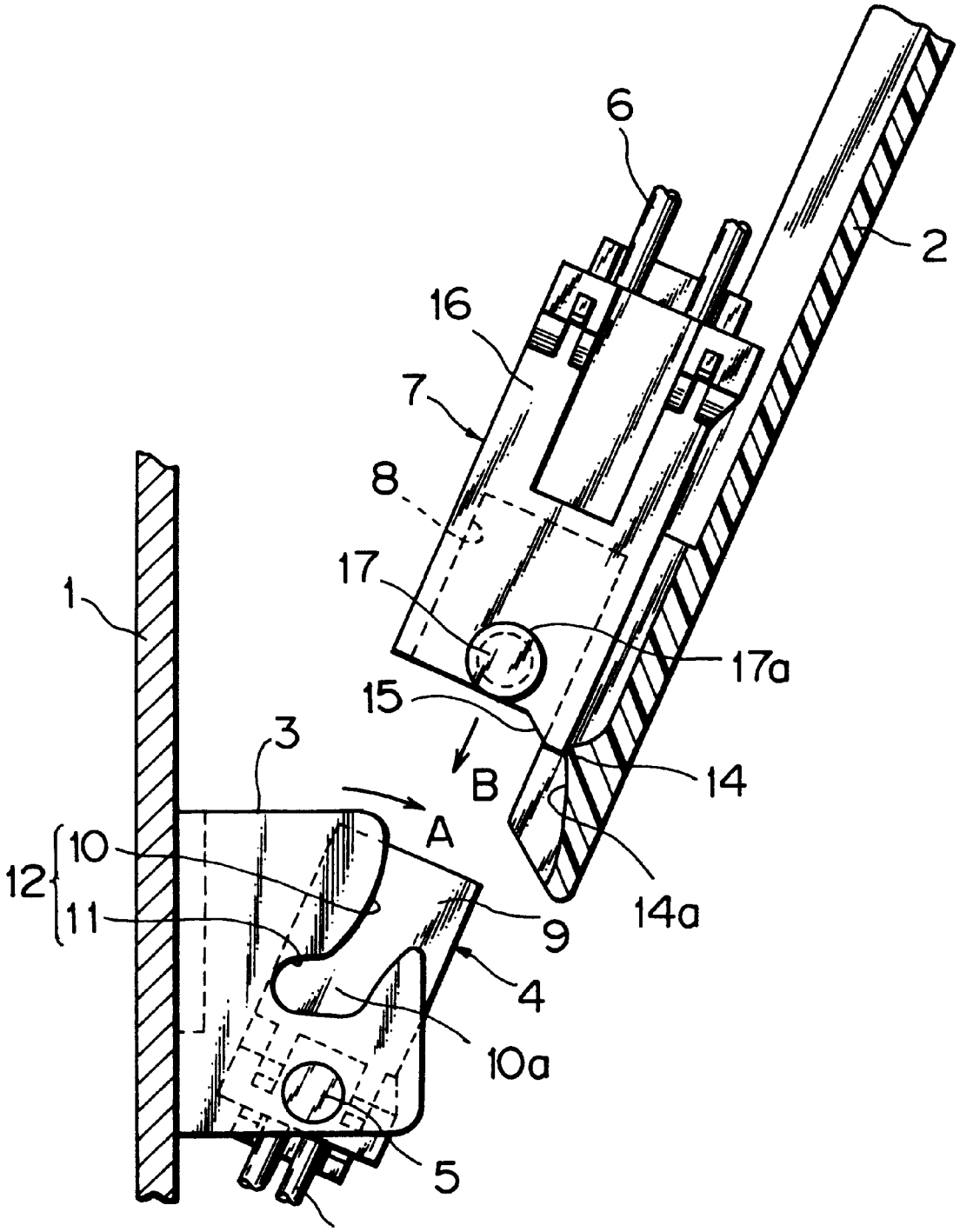
FIG. 1 is a side view showing an embodiment of an electrical connector mating structure according to the present invention, in which a pair of connectors are aligned before mating thereof.
Figure 3:
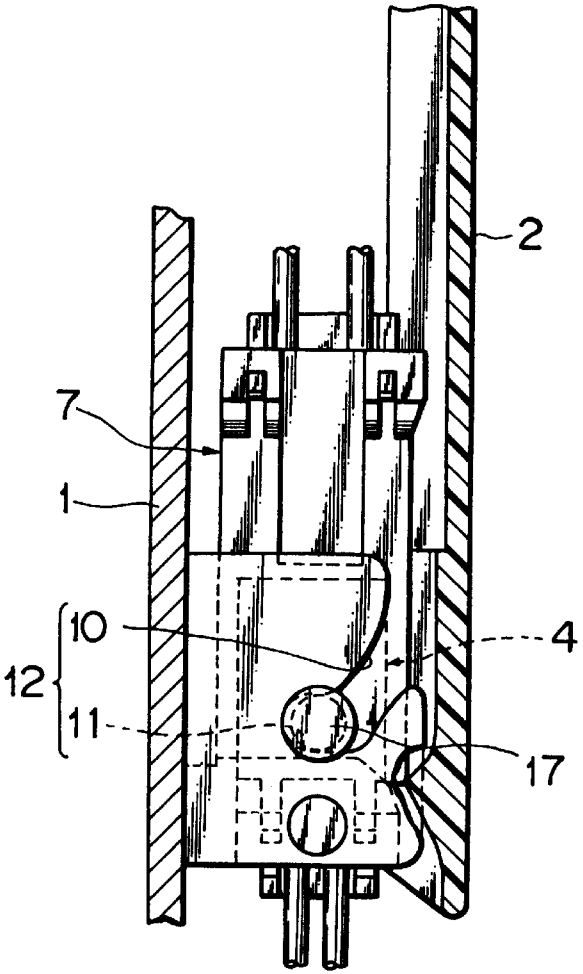
FIG. 3 is a side view showing a state where a fitting panel (a pillar trim) has been fitted to a base body (a pillar)
Figure 2:
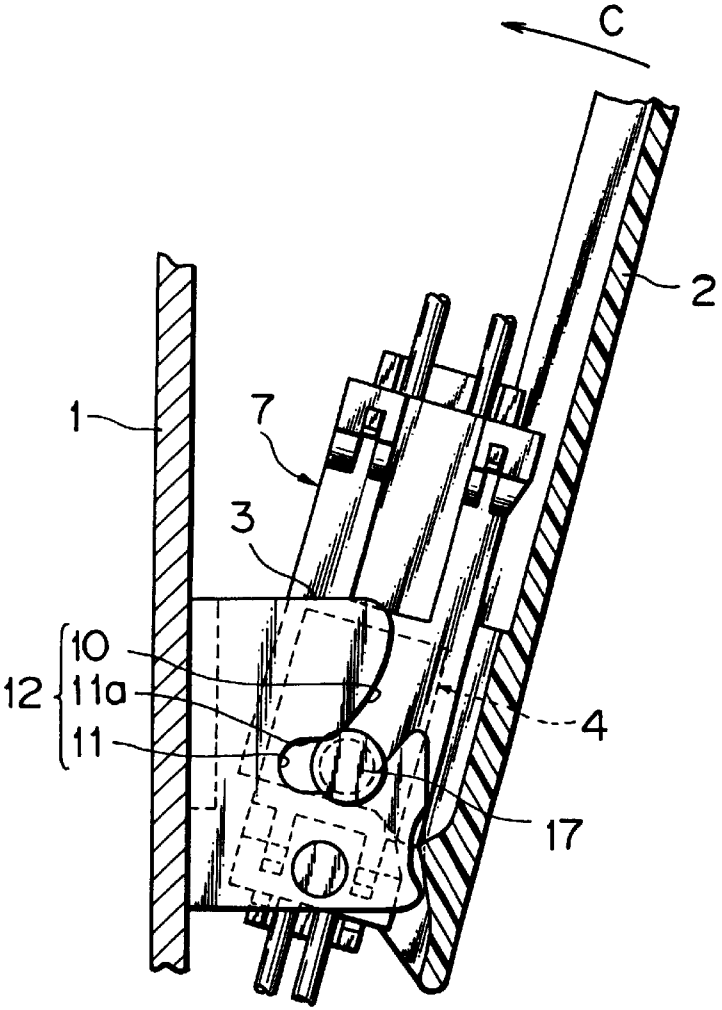
FIG. 2 is a side view showing the complete mating state of the connectors.

FIGS. 1 to 3 show an embodiment of an electrical connector mating structure according to the present invention. The mating structure relates to the connection of a wiring harness around a car pillar.

In FIG. 1, denoted 1 is a metal pillar composing partially a base body of a car, and numeral 2 is a synthetic resin pillar trim that is a fitting panel. The pillar 1 is fitted with a vertical rectangular bracket 3 made of metal or synthetic resin. The bracket 3 is fitted with a male connector (a first connector) 4 that can pivot around a pivot pin 5 toward the pillar 1. Meanwhile, the pillar trim 2 is fixedly fitted with a wiring harness 6 and a female connector (a second connector) 7.

In this embodiments, the female connector 7 has an associated connector receiving chamber 8, and the associated connector inserted into connector receiving chamber 8 is called as a male connector 4 hereinafter. The male connector 4 accommodates a plurality of receptacle terminals (not shown), while the female connector 7 accommodates a plurality of pin terminals (not shown). The pin terminals have been connected to one end of the wiring harness (electrical wires) 6.

To pivot the male connector 4, one of the bracket 3 and a synthetic resin male connector housing 9 has the horizontal pivoting pin 5, while the other has a connection hole (not shown) associated with the pivoting pin. Alternatively, the pivoting pin 5 may be a bolt that passes horizontally through both the bracket 3 and the male connector 4 to pivotably support the male connector 4. Preferably, a pair of the brackets 3 are arranged respectively at each side of the male connector 4 to support it.

The pivoting pin 5 is located in a lower side of the bracket 3, and the bracket 3 has a slightly larger height than the male connector 4. The bracket 3 is formed with a guide opening (a guide portion) 12 extending from a fore end portion thereof (an end portion parallel to the pillar 1) inwardly to the middle of the bracket 3. That is, the guide opening 12 is defined to receive the male connector 4. The guide opening 12 consists of both an inclined portion 10 of a diagonal slit and a lock opening 11 extending from the inner end of the inclined portion 10 perpendicularly to the pillar 1 located in a horizontal direction in FIG. 1. Alternatively, the guide opening 12 may be a guide groove.

The male connector 4 is provisionally locked in a position with substantially the same angle as the inclined portion 10 of the guide opening 12. The provisional lock mean, for example, includes a lock projection (not shown) provided in the male connector housing 9 and an associated connection hole (not shown) defined in the bracket 3. An end portion of the male connector 4 is protruding diagonally upwardly from the bracket 3.

From the male connector 4, a flexible wiring harness 13 extends to lead to an instrument panel (not shown). The male connector 4 can be oriented to align with the female connector 7.

On the pillar trim 2 is fixedly disposed a wiring harness 6 in an inner surface thereof, and the pillar trim 2 has a female connector 7 secured to a lower end portion thereof. The pillar trim 2 has a guide protrusion 14 with a tapered guide surface 14*a* formed inside one end of the pillar trim 2 for guiding the mating end of the male connector 4. The guide surface 14*a* is adjacent to a tapered end portion 15 of the female connector 7.

The female connector 7 has a synthetic resin connector housing 16, an outer wall of which is formed with a lock pin 17 (an engagement piece) of a short column shape near the fore end thereof. The lock pin 17 is associated with the guide opening 12 of the bracket 3. Preferably, a pair of left and right lock pins 17 are provided for a pair of the guide openings 12. The inclined portion 10 has such a length in relation to the location of the lock pin 17 that the male and female connectors 4, 7 can mate completely with each other when the lock pin 17 has reached the inner end 10*a* of the inclined portion 10 of the guide opening 12. The lock pin 17 has a flange 17*a* to hang itself to the bracket 3.

As shown in FIG. 1, the male connector 4 is initially inclined outwardly toward the pillar 1 (in the arrow A direction), while the pillar trim 2 advances diagonally downward (in the arrow B direction), so that the female connector 7 mounted on the pillar trim 2 mates with the male connector 4 attached to the pillar 1. During the mating of the connectors 4, 7, the lock pin 17 of the female connector 7 slides along the inclined portion 10 of the guide opening 12 of the bracket 3.

Then, as shown in FIG. 2, the connectors 4, 7 mate completely with each other, while the lock pin 17 of the female connector 7 is positioned at the inner end of the inclined portion 10 and also at the entrance of the lock opening 11. Next, the pillar trim 2 is pivoted toward the pillar 1 in the arrow C direction. The pivoting operation, which has been discussed in FIG. 3, forces the lock pin 17 to advance into the lock opening 11 of the guide opening 12 so that the pillar trim 2 is attached completely to the pillar 1.

In FIG. 2, incomplete mating of the connectors 4, 7 causes the lock pin 17 to be located in a middle portion of the inclined portion 10 of the guide opening 12. In this state, the pillar trim 2 is prevented from pivoting in the arrow C direction since the lock pin 17 abuts against the inclined portion 10 of the guide opening 12. Thereby, it is recognized that the connectors 4, 7 have not mated completely with each other.

However, in such a slight incomplete mating of the connectors that the lock pin 17 is positioned a little apart from the inner end of the inclined portion 1, pivoting operation of the pillar trim 2 forces the lock pin 17 to advance into the lock opening 11, allowing the complete mating of the connectors 4, 7.

Referring to FIG. 3 showing the complete mating state of the connectors, the lock pin 17 has engaged with the lock opening 11 of the guide opening 12. The engagement surface 11*a* (FIG. 2) of the lock opening 11 extends perpendicularly to the disengagement direction of the female connector 7 so that the female connector 7 is secured to the bracket 3, preventing disengagement of the female connector 7. Meanwhile, the male connector 4 has been attached to the bracket 3 by way of the pivoting pin 5. Thus, the engagement of the lock pin 17 with the lock opening 11 enables a sure locking state of the connectors 4, 7, preventing the engagement of the connectors 4, 7 from loosening even by vibrations during operation of the car and preventing the terminals in the connectors from wearing due to sliding thereof.

In addition, the pillar trim 2 is fitted to the pillar 1 only by simply pivoting the pillar trim 2 around the pin 5 after the mating of the connector. That is, the final position of the pillar trim 2 has been determined by the pin 5, so that the pillar trim 2 may not require a special alignment in relation to the pillar 1, enabling a simplified, sure fitting work of the pillar trim 2.

FIGS. 4 to 7 show another embodiment of an electrical connector mating structure according to the present invention, in which a mating structure of a pair of connectors each disposed on the aforementioned pillar or pillar trim is illustrated.

Figure 4:
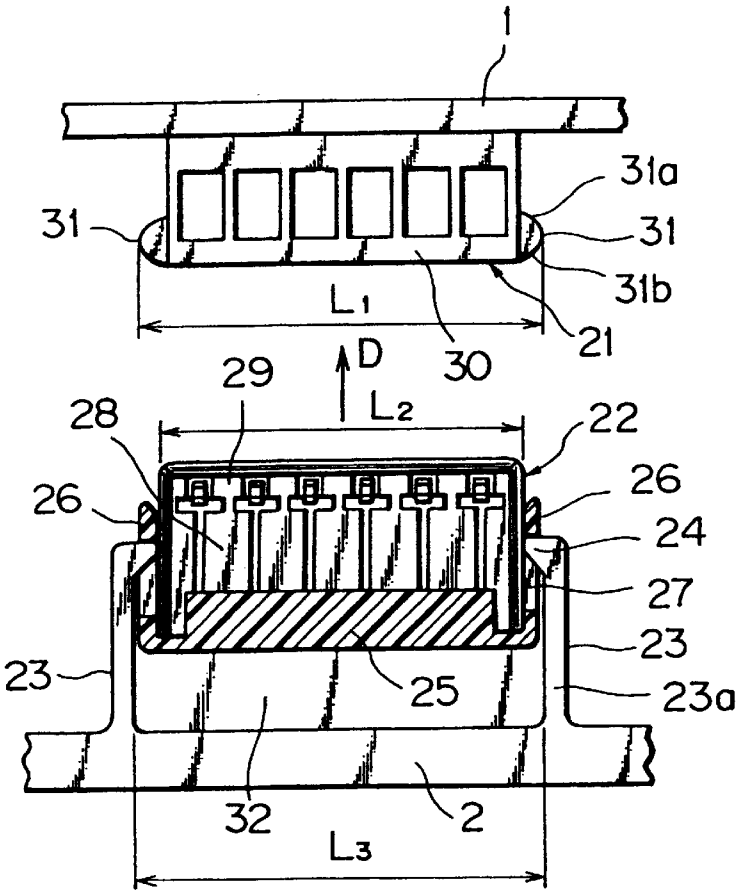
FIG. 4 is a cross-sectional view showing another embodiment of an electrical connector mating structure according to the present invention, in which a pair of connectors are aligned before mating thereof.

In FIG. 4, denoted 1 is a pillar (a base body); 21 a female connector (a third connector) fixed to the pillar 1; 2 is a pillar trim (a fitting panel); and 22 a male connector (a fourth connector) slidably held by the pillar trim 2.

Figure 5:
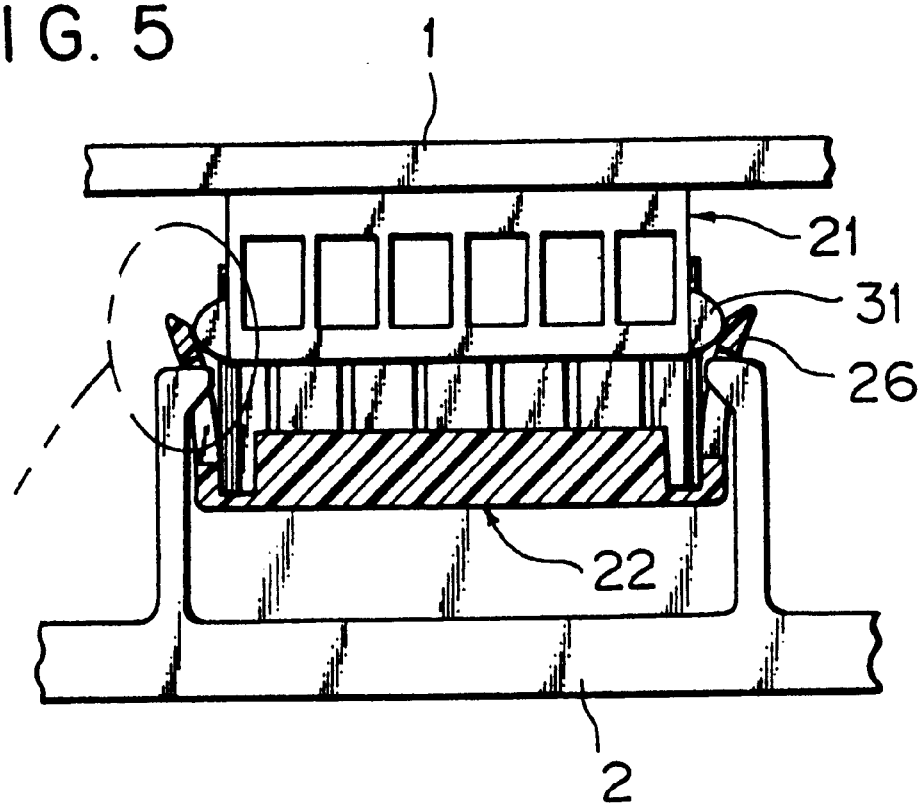
FIG. 5 is a cross-sectional view showing the connectors which are halfway of the mating, and an encircled part is a partial enlarged view of the same.
Figure 5A:
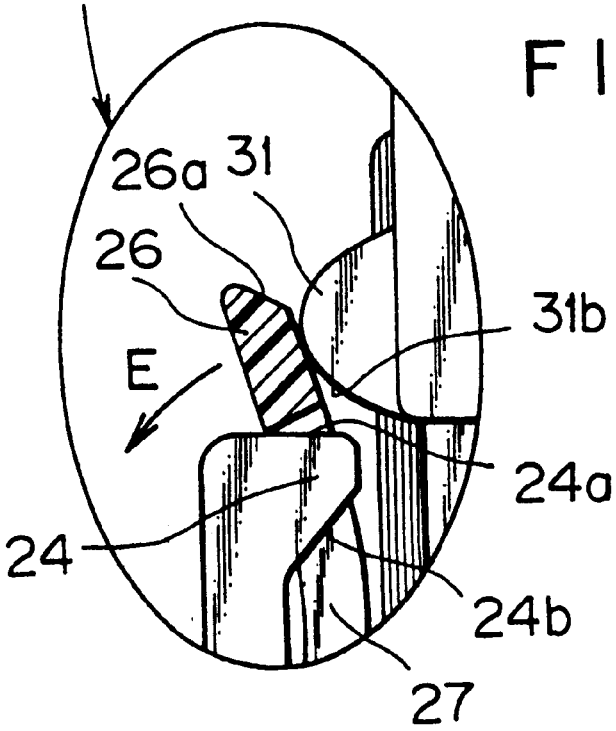
Figure 9:
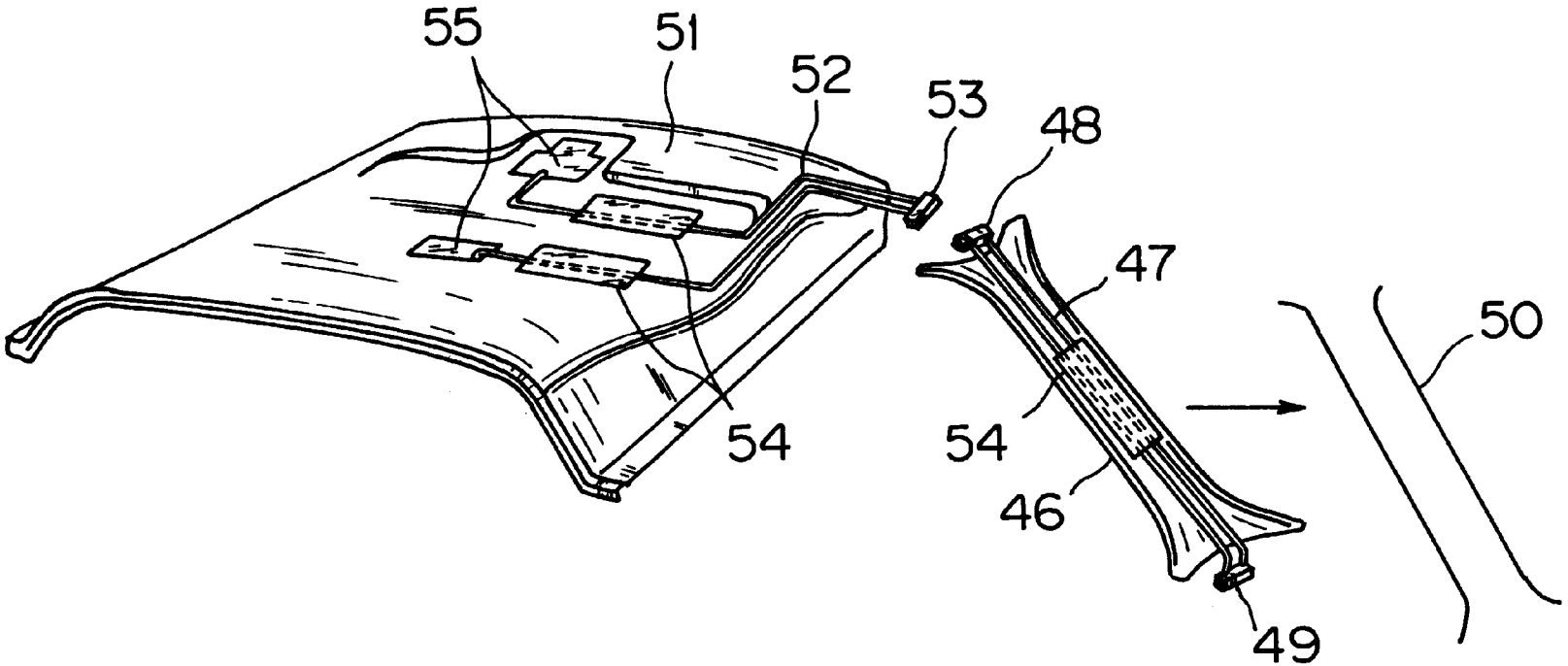
FIG. 9 PRIOR ART
FIG. 9 is an exploded perspective view showing another conventional electrical connector mating structure.
Figure 10:
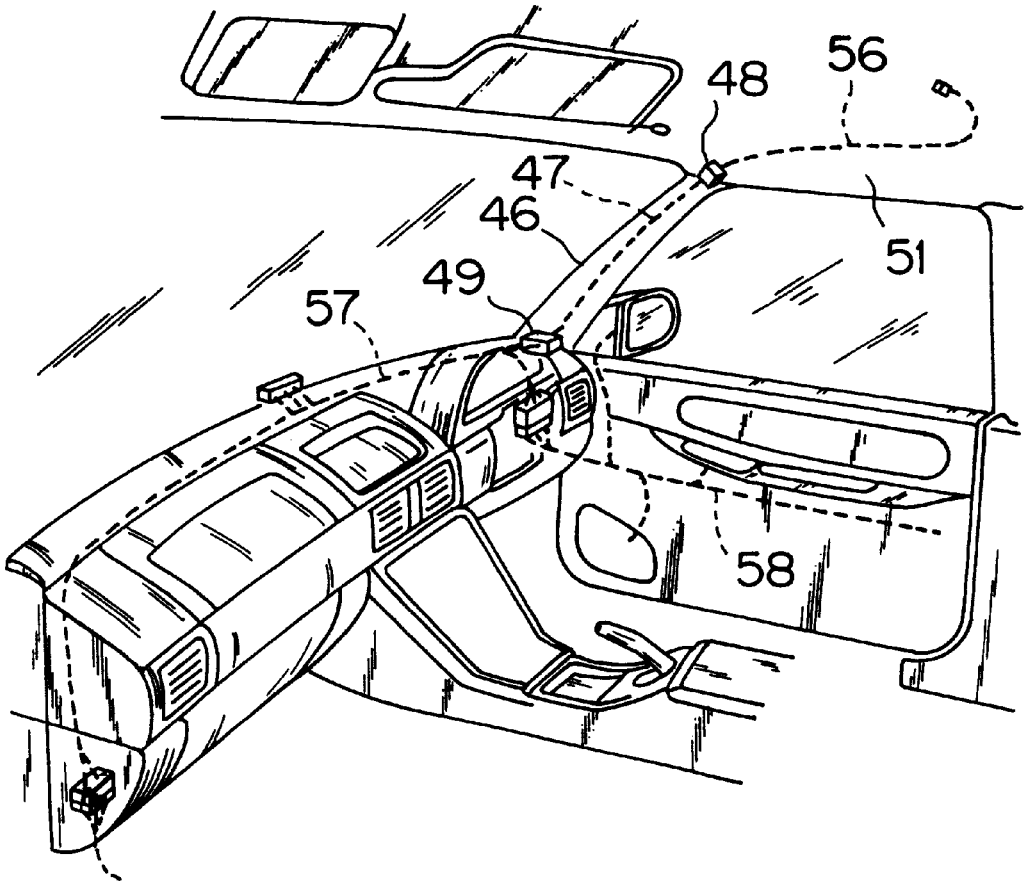
FIG. 10 PRIOR ART
FIG. 10 is a perspective view showing a state where the conventional mating structure has been assembled in a car.

The pillar trim 2 is unitedly formed with a pair of left and right resilient holding arms (holders) 23. Each holding arm 23 has a leading end with an inwardly protruding engagement projection 24. The engagement projection 24 has a front abutting surface 24*a* (FIG. 5) perpendicular to the longitudinal direction of the holding arm 23 and has a tapered rear guide surface 24*b* (FIG. 5). The over all length of the holding arm 23 is larger than the height of the male connector 22, so that the holding arm 23 can have a receiving space 32 for the male connector 22.

The male connector 22 includes a male connector housing 25 made of a synthetic resin, on each side of which a pair of resilient connection arms 26 each are unitedly formed. Each connection arm 26 has a connection hole (an elongated hole) 27 associated with the engagement projection 24. When the projection 24 has engaged with the hole 27, the male connector 22 is extending from the holding arm 23 in the connector mating direction (as shown by the arrow D).

The connection arm 26 has a fore end that has an inside tapered guide face 26*a* (FIG. 5) associated with a connecting protrusion 31, which will be discussed later, of the female connector 21. The connection arm 26 is raised from a rear end of the male connector housing 25 and is extending parallel to the holding arm 23. The connection hole 27 is elongated in the longitudinal direction of the holding arm 23. The male connector 22 can move toward and away from the pillar trim 2 within a gap between the connection hole 27 and the engagement projection 24. However, the connection hole 27 is not necessarily an elongated one.

The connection arm 26 can deflect outwardly as well as the holding arm 23. When the projection 24 has engaged with the hole 27, the peak point of the engagement projection 24 is located in substantially the same plane as the inner surface of the connection arm 26. An end surface 24*a* (FIG. 5) of the engagement projection 24 abuts against a fore end surface of the connection hole 27 of the connection arm 26, which prevents the male connector 2 from further moving toward the pillar trim 2.

The male connector housing 25 has a plurality of parallelly aligned terminal receiving chambers 28 with an insertion opening 29 for receiving associated opposing terminals in a direction perpendicular to the pillar trim 2. Each terminal receiving chamber 28 accommodates a receptacle terminal (not shown), which is connected to an end of the wiring harness 6 shown in FIG. 1.

Meanwhile, the female connector 21 fixed to the pillar 1 includes a synthetic resin female connector housing 30 that has a pair of connecting protrusions 31 respectively formed on each side wall thereof. Each connecting protrusion 31 is engageable with one of the connection holes 27 of the connection arm 26 of the male connector housing 25. The connecting protrusion 31 has gentle slopes consisting of curved surfaces 31*a*, 31*b* that are symmetrically formed toward the pillar side and the opposite side. The distance $L_1$ between the innermost points of the pair of connecting protrusions 31 is larger than the inner distance $L_2$ of the pair of connection arms 26 and is larger than the distance ($L_2$) between the innermost points of the pair of engagement projections 24 but smaller than the inner distance $L_3$ between straight portions 23*a* of the holding arms, 23. The connecting protrusion 31 can engage with the connection hole 27 of the connection arm 26 to move within the connection hole 27 in the connector engagement direction.

The female connector housing 31 fixed to the pillar 1 accommodates a plurality of parallelly aligned pin terminals (not shown) that are connected to a wiring harness (not shown) disposed in a car roof side. The female connector housing 30 is secured to the pillar 1 by clips (not shown) unitedly formed in the pillar 1. Alternatively, in place of the pin and receptacle terminals (not shown), terminals each having an elastic contact piece and opposing terminals each having a contact tab may be applied.

Pivoting the pillar trim 2, as shown in FIG. 2, moves the male connector 22 together with the pillar trim 2 in the arrow D direction shown in FIG. 4 to come dose to the female connector 21 mounted on the pillar. Then, as shown in FIG. 5, the connectors 21, 22 begin to mate with each other. In the step, the fore end of the connection arm 26 slidingly contacts the fore curved surface 31*b* of the connecting protrusion 31 to gradually deflect the connection arm 26 outwardly in the arrow E direction. While the engagement projection 24 has been within the connection hole 27, the fore end surface 24a is abutting against the connection arm 26 in the connector mating direction. Thereby, the male connector 22 can mate with the female connector 21.

Figure 6:
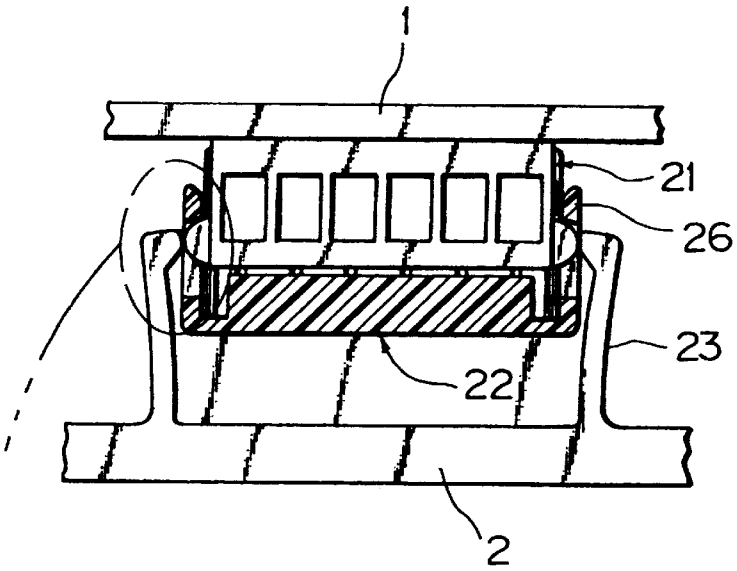
FIG. 6 is a cross-sectional view showing the connectors which are in a state just before the complete mating, and an encircled part is a partial enlarged view of the same.
Figure 6A:
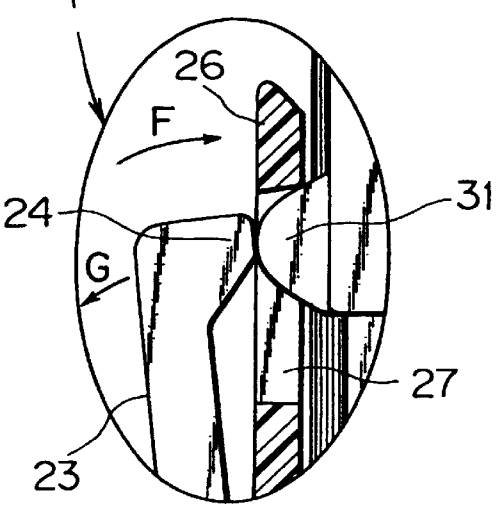

As shown in FIG. 6, a little before the complete mating of the connectors 21, 22, the connection arm 26 returns to its original position in the arrow F direction. At the same time, the connecting protrusion 31 enters the connection hole 27 of the connection arm 26, and the connecting protrusion 31 pushes out the engagement projection 24 outwardly from the connection hole 27 in the arrow G direction. The outermost point of the engagement projection 24 abuts against the innermost point of the connecting protrusion 31, which deflects the holding arm 23 outwardly. Accordingly, the male connector 22 is finally released from the holding arm 23.

During the fitting step of the pillar trim 2, the engagement projection 24 slidingly contact an outer side surface of the connection arm 26. Then, as shown in FIG. 7, simultaneously with the fitting completion of the pillar trim 2, the engagement projection 24 rides over the connection arm 26, and the holding arm 23 returns inwardly to its original position. The engagement projection 24 is finally positioned forward from the fore end of the connection arm 26. In FIG. 7, it may be also applicable that, during the fitting completion of the pillar trim 2, the pillar trim 2 pushes the male connector 22 to mate completely it with the female connector 21. This enables to recognize the complete mating of the connectors by the complete fitting of the pillar trim 2 to the pillar 1. However, the embodiment shown in FIG. 6 also presents no problem, in which the connectors have mated with each other before the completion of fitting of the pillar trim 2.

The male connector 22 is finally released from the holding arms 23, so that the male connector 22, which has mated with the female connector 21, is free from the pillar trim 2. The connectors 21, 22 are received in the receiving space 32 (FIG. 4) defined inside the holding arms 23. The fore end surface 24*a* of each holding arm 23 abuts against the pillar 1 so that the pillar trim 2 is completely fitted to the pillar 1.

In an incomplete mating state of the connectors shown in FIG. 5, the pillar trim 2 is also incompletely fitted to the pillar 1. A person in charge can recognize a possibility of incomplete mating of the connectors 21, 22 by inspecting the fitting state of the pillar trim 2 to the pillar 1. To correct the incomplete mating, the person pushes forcedly the pillar trim 2 toward the pillar 1, which can mate completely the connectors 21, 22 with ease.

Furthermore, in the complete mating state of the connectors shown in FIG. 7 where the pillar trim has been fitted completely to the pillar, the male connector 22 is released from the holding arm 23 to be free from the pillar trim 2. At the same time, the connectors 21, 22 are locked to each other, preventing a relative movement between the connectors 21, 22. Thus, even where the pillar 1 or the pillar trim 2 vibrates due to operation of the car, the vibration provides no adverse effect on the connectors 21, 22, which keeps a correct electrical connection thereof and prevents the terminals in the connectors 21, 22 from sliding mutually, causing no wearing thereof.

In addition, the embodiment configurations related to a pillar and its pillar trim of a car may be also applied to various types of connectors related to a base body and its fitting panel.

What is claimed is:

1. An electrical connector mating structure comprising:

a bracket defined to be fitted to a base body, said bracket having a guide portion that includes an inclined portion and a lock opening turned from said inclined portion, a first connector pivotably attached to said bracket, and a second connector provided on a fitting panel constructed to be attached to the base body, said second connector having an engagement piece engaged with said guide portion of said bracket, wherein the fitting panel is pivotable toward the base body when said first and second connectors have mated completely.

2. The mating structure as recited in claim 1, wherein said first connector can be preliminarily supported by said bracket with said first connector being inclined to the base body, and said inclined portion is extending in a direction so that said first and second connectors can mate with each other, said first and second connectors completely mating with each other when said engagement piece has reached said lock opening, said lock opening being directed perpendicularly to a disengagement direction of said first and second connectors when said fitting panel has completely pivoted toward the base body.

3. The mating structure as recited in claim 1, further comprising:

a third connector mounted on said base body, said third connector having a connecting protrusion, a resilient holding arm mounted on said fitting panel, said resilient holding arm having an engagement projection, a fourth connector provisionally held by said resilient holding arm, said fourth connector having a resilient connection arm with a connection hole, said connection hole provisionally engaging with said connecting protrusion, wherein the connecting protrusion can deflect said resilient connection arm during mating of said third and fourth connectors so that said connecting protrusion pushes said resilient holding arm to disengage it from the connection hole, and the connecting protrusion can engage with the connection hole when said third and fourth connectors mate with each other completely.

4. The mating structure as recited in claim 3, wherein a receiving space for accommodating said mated third and fourth connectors is provided inside a pair of said holding arms each positioned at each side of the fourth connector, and said fourth connector is positioned to extend from said holding arm in the engagement direction of said connectors when said engagement projection has engaged with said connection hole.

5. An electrical connector mating structure comprising:

a first connector mounted on a base body, said first connector having a connecting protrusion, a resilient holding arm mounted on a fitting panel constructed to be attached to the base body, said resilient holding arm having an engagement projection, a second connector provisionally held by said resilient holding arm, said second connector having a resilient connection arm with a connection hole, said connection hole provisionally engaging with said connecting protrusion, wherein said connecting protrusion can deflect said resilient connection arm during mating of said first and second connectors so that said connecting protrusion pushes said resilient holding arm to disengage it from the connection hole, and said connecting protrusion can engage with the connection hole when said first and second connectors mate with each other completely.

6. The mating structure as recited in claim 5, wherein a receiving space for accommodating the mated first and second connectors is provided inside a pair of said holding arms each positioned at each side of the second connector, and said second connector is protruding from said holding arm in the engagement direction of said second connector when said engagement projection has engaged with said connection hole.

* * * * *

UNITED STATES PATENT AND TRADEMARK OFFICE

CERTIFICATE OF CORRECTION

PATENT NO. : 6,095,831

DATED : August 1, 2000

INVENTOR(S) : MURAMATSU et al.

It is certified that error appears in the above-identified patent and that said Letters Patent is hereby corrected as shown below:

On the title page of the patent in item [75] the Foreign Application Priority Data, change "May 3, 1998 [JP] Japan ..... 10-053539" to be --March 5, 1998 [JP] Japan ..... 10-053539--

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*